US009587806B2

(12) United States Patent
Liu

(10) Patent No.: US 9,587,806 B2
(45) Date of Patent: Mar. 7, 2017

(54) CHRISTMAS ROTATING ORNAMENT

(71) Applicant: Nature's Mark, LLC, Houston, TX (US)

(72) Inventor: Conggang Liu, Dongguan (CN)

(73) Assignee: Nature's Mark, LLC, Houston, TX (US)

( * ) Notice: Subject to any disclaimer, the term of this patent is extended or adjusted under 35 U.S.C. 154(b) by 7 days.

(21) Appl. No.: 14/939,010

(22) Filed: Nov. 12, 2015

(65) Prior Publication Data

US 2017/0038035 A1 Feb. 9, 2017

(30) Foreign Application Priority Data

Aug. 7, 2015 (CN) ..... 2015 1 0478041

(51) Int. Cl.

| | |
|---|---|
| ***F21V 23/04*** | (2006.01) |
| ***F21V 14/08*** | (2006.01) |
| ***F21V 3/02*** | (2006.01) |
| ***F21V 21/08*** | (2006.01) |
| ***F21V 17/00*** | (2006.01) |
| ***F21V 3/04*** | (2006.01) |
| *F21W 121/00* | (2006.01) |
| *F21Y 101/02* | (2006.01) |

(52) U.S. Cl.

CPC ..... *F21V 14/08* (2013.01); *F21V 3/02* (2013.01); *F21V 3/0427* (2013.01); *F21V 17/002* (2013.01); *F21V 21/08* (2013.01); *F21V 23/0442* (2013.01); *F21W 2121/00* (2013.01); *F21Y 2101/02* (2013.01)

(58) Field of Classification Search

CPC ..... F21V 14/08; F21V 3/02; F21V 3/0427; F21V 17/002; F21V 21/08; F21V 23/0442

USPC ..... 362/276

See application file for complete search history.

(56) References Cited

U.S. PATENT DOCUMENTS

| | | | | | |
|---|---|---|---|---|---|
| 2,339,385 | A | | 1/1944 | Dupler | |
| 2,726,320 | A | * | 12/1955 | Damiano | A47G 33/0809 40/441 |
| 3,764,799 | A | * | 10/1973 | Schulz | B60Q 1/2611 340/472 |
| 3,808,721 | A | * | 5/1974 | Gersch | G09F 19/12 362/232 |
| 4,173,038 | A | * | 10/1979 | Kiefer | F21S 10/02 362/35 |
| 4,652,980 | A | * | 3/1987 | Segan | A47G 33/0818 362/157 |
| 5,274,537 | A | | 12/1993 | Altman | |

(Continued)

*Primary Examiner* — Bryon T Gyllstrom

(74) *Attorney, Agent, or Firm* — Whitaker Chalk Swindle & Schwartz PLLC; Charles Gunter

(57) ABSTRACT

A festive atmosphere decorative lighting device which includes a lamp base, an LED bulb set inside the lamp base and an electrical switch for the bulb. A spinning assembly housed in the lamp base has an output shaft which is connected to an inner cover for spinning the inner cover. The inner cover fits over the LED bulb and has a cutout pattern of holes. The lamp base is also fitted with a transparent lamp shade which is superimposed above the inner cover. When the LED bulb is switched on and the spinning configuration spins the inner cover, light emitted by the LED bulb passes through the holes in the inner cover and presents a flowing vivid silhouette, as observed by a viewer.

14 Claims, 4 Drawing Sheets

(56) References Cited

U.S. PATENT DOCUMENTS

| | | | | | |
|---|---|---|---|---|---|
| 5,499,167 | A * | 3/1996 | Brown | B60Q 1/2611 | 362/35 |
| 5,890,794 | A * | 4/1999 | Abtahi | B60Q 7/00 | 362/183 |
| 6,052,930 | A | 4/2000 | Hermanson et al. | | |
| 6,145,228 | A * | 11/2000 | LaChance | G09F 13/00 | 362/441 |
| 6,902,297 | B1 | 6/2005 | Fung | | |
| 7,188,976 | B1 | 3/2007 | Fung | | |
| 2002/0114161 | A1 * | 8/2002 | Barnett | B60Q 1/2611 | 362/282 |
| 2008/0014384 | A1 * | 1/2008 | Lin | A47G 19/24 | 428/34.1 |
| 2010/0314985 | A1 * | 12/2010 | Premysler | F21V 29/402 | 313/46 |

* cited by examiner

CHRISTMAS ROTATING ORNAMENT

CROSS REFERENCE TO RELATED APPLICATION

The present application claims priority from an earlier filed Chinese utility patent application entitled "Christmas Rotating Ornament", Serial No. 201510478041.6, filed Aug. 7, 2015, by the same inventor.

BACKGROUND OF THE INVENTION

Field of the Invention

The present invention relates to a lighting fixture, and more particularly to a kind of festive atmosphere decorative lighting device.

Description of the Prior Art

Christmas holidays, as well as other festive occasions, often involve the use of atmospheric lighting devices in order to increase the festival atmosphere. Other than the general lighting fixtures, there have also been various special purpose atmospheric decorative lighting products known in the past to provide this type of decorative effect. One such known device accomplishes the decorative effect by illuminating a static body, for example, through patterns on a lamp shade or on a bulb associated with the device. These types of lighting fixtures thus provide the decorative effect through the light and shadow projection produced by lighting through the patterns.

Since these prior art decorative lighting devices have generally involved patterns on a lamp shade or on a bulb, they were generally limited to a single expression of the shadow projection. Other devices involved the use of a glass or plastic globe, but again the devices were limited in the types of displays they involved. While certainly decorative, these devices leave room for improvement in enhancing the decorative effects of atmospheric lighting products. The following are some examples of other typical prior art devices of the general type under discussion which will help to make clear the improvements brought about by the decorative lighting product of the invention. These prior art patents are merely intended to be representative of the general state of the art:

U.S. Pat. No. 2,339,385 to Dupler teaches the combination of a glass globe having an opening therein, a tubular sleeve of plastic material fitting into the opening, an annular series of relatively narrow outwardly extending resilient ribs integral with the sleeve and frictionally engaging the edge wall of the opening, the ribs normally extending outwardly beyond the circumference of the opening and being compressed during application of the sleeve to the globe, each rib being of gradually increasing thickness with the thinner end at the inner end portion of the sleeve.

U.S. Pat. No. 5,274,537 to Altman teaches a decorative lighting arrangement utilizing a standard commercial illuminated marker, such as one which outlines a walk, a driveway or the like. The invention provides a substitute decorative component or structure which serves to replace the shade-cover typically found on the presently available marker in order to present a holiday or special occasion motif.

U.S. Pat. No. 6,902,297 to Fung shows a lamp cover comprising a hollow shell having an exterior surface in the form of a decorative shape and an interior surface having pliant ribs extending inwardly from the interior surface, which ribs are of a size and shape as to frictionally engage the exterior of a light fixture lens, bulb cover or bulb. The hollow pliant shell is translucent, portions of the hollow pliant shell are made opaque and the hollow pliant shell is colored. A lamp cover base assembly is also shown for attaching a variety of decorative lamp covers to lamps and lamp bases.

U.S. Pat. No. 6,052,930 to Hermanson et al. shows an ornamental display globe which includes a transparent hollow sphere filled with a transparent liquid and a figurine disposed inside the sphere. The figurine is maintained in a preferred orientation in the transparent liquid when the transparent hollow sphere is subjected to movement.

U.S. Pat. No. 4,173,038 to Kiefer shows a light device for projecting a variety of different images in various changing colors onto a translucent surface to provide the visual portion of audio visual entertainment. The primary embodiment has a box-like container with one or more sides of translucent material. An openable top cover permits ready access to the interior of the device which has mounted therein a support stand provided with a plurality of different color flashing lights.

SUMMARY OF THE INVENTION

It is an object of the present invention to provide an improved atmospheric lighting device which will provide special decorative effects which involve rich forms of expression.

The festive atmosphere decorative lighting device of the invention includes a lamp base and an LED bulb set inside the lamp base. A switch assembly is contained within the base in electrical communication with the LED bulb for switching the LED bulb on and off. A spinning component assembly is also located in the lamp base and includes an output shaft which is operably associated with an inner cover for causing the inner cover to spin. The inner cover is arranged on the lamp base to cover the LED bulb. The inner cover is provided with a cutout pattern of holes. The lamp base also carries a transparent lamp shade, the transparent lamp shade being located outside the inner cover and surrounding the inner cover.

The spinning component assembly, in one form, includes a drive motor, an associated gear reduction configuration and a mounting base. The gear reduction configuration has a plurality of driven gears which are connected to an output shaft of the drive motor by a worm gear. The mounting base is located above the gear reduction configuration and below the inner cover when assembled, and wherein the inner cover is attached to the mounting base.

The LED bulb sits inside the lamp base above the mounting base, the LED bulb being mounted on an outer extent of an output shaft of the gear reduction configuration. Rotation of the output shaft of the gear reduction configuration causes rotation of the mounting base and, in turn, rotation of the inner cover.

Preferably, the LED bulb has a mounting axis passing longitudinally through a center point of the Led bulb exterior, and wherein the LED bulb's mounting axis is vertical to a horizontal planar surface of the lighting base. The inner cover has a spinning axis defined along a vertical axis thereof, the inner cover's spinning axis being coaxial with the LED bulb's mounting axis. The lamp shade and the inner cover are both spherically shaped and are coaxially arranged with the LED bulb mounting axis.

The mounting base has a top surface provided with a circular groove, and wherein the inner cover is detachably engaged in the circular groove. The lamp shade is also detachably engaged in the lamp base.

The lamp shade has an internal surface and an external surface, a selected one of which is preferably colored with a coloring layer. The lamp shade can also be provided with a frosting applied to an internal surface thereof to form a frosted diffuse layer.

The lamp switch configuration can further comprise a sound/light sensor control switch.

In one embodiment, the lamp base is hung with a suspension device. The suspension device can include a suspension hook extending upwardly above the lamp shade top in use. The hook has a downwardly extending shaft which has multiple fixed strips depending therefrom. Each of the fixed strips has a lower end which is connected to the lamp base. Preferably, the fixed strips are symmetrically distributed along the lamp shade lower periphery.

As has been described, the inner cover is located between the LED bulb and the transparent lamp shade. In use, by control of the switch assembly, the LED bulb is energized and emits light. The spinning configuration starts to drive the inner cover, causing it to spin, and accordingly the cutout inner cover spins with respect to the LED bulb, so as to enable the emitting light going through the cutout patterned holes to present a flowing vivid silhouette, which is a very pleasing visual expression as a decorative lighting effect.

Additional objects, features and advantages will be apparent in the written description which follows.

BRIEF DESCRIPTION OF THE DRAWINGS

In order to describe the present invention or existing technical solution more clearly, a preferred form of the present invention will now be described by way of example with reference to the accompanying drawings. The accompanying drawings are merely preferred embodiments of the present invention and should not be construed as limiting the scope of the invention.

DETAILED DESCRIPTION OF THE INVENTION

In order to further describe the purpose of the present invention, the technical solution and advantages more clearly, the disclosure incorporates the accompanying drawings as well as the detailed description which follows. It should be understood, however, that the preferred embodiments described herein are merely for the better understanding of the present invention and the technical solution, and should not be used to limit the present invention.

Figure 1:
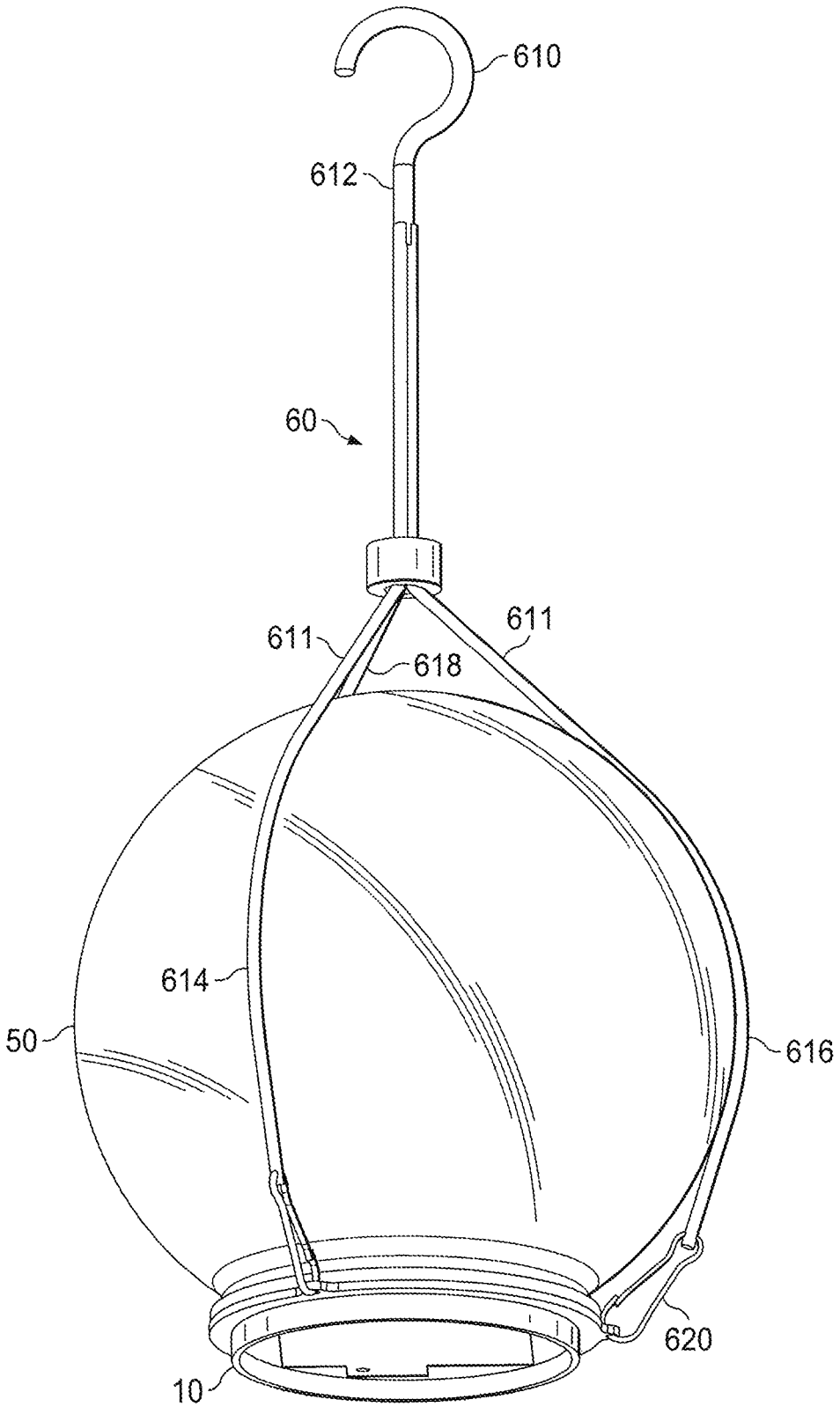
FIG. 1 is a side elevation of one embodiment of a festive atmosphere decorative lighting device of the invention.
Figure 2:
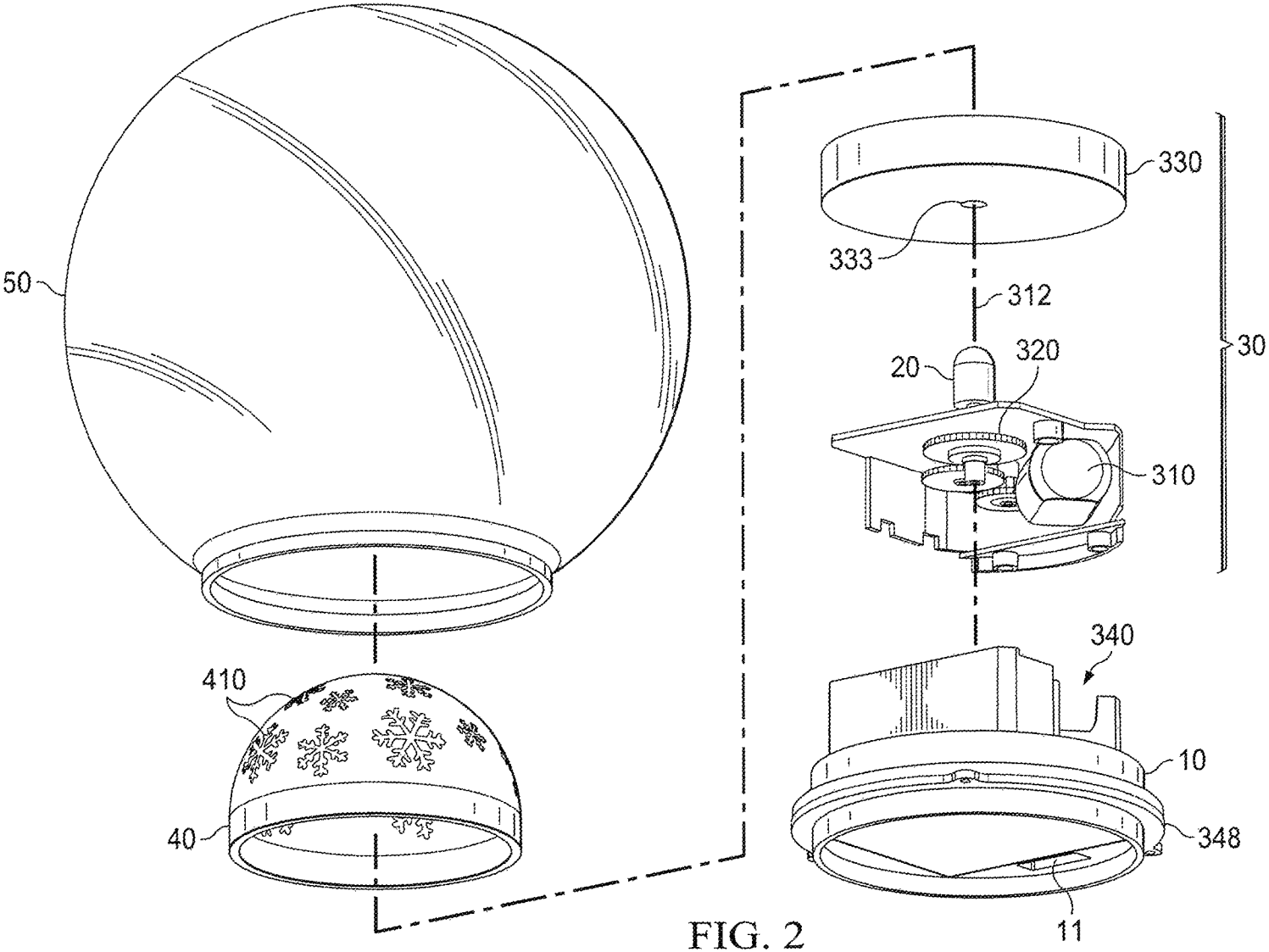
FIG. 2 is an exploded view of the device of FIG. 1, showing the component parts thereof.

FIGS. 1 and 2 depict the festive atmosphere decorative lighting device of the invention. As has been briefly described, the lighting device of the invention in one preferred form includes: a lamp base 10 and an LED bulb set (such as 20 in FIG. 2) inside the lamp base 10 which is operably controlled by a switch assembly. The switch assembly can be any of a number of conveniently available simple electromechanical devices with two sets of electrical contacts which are connected to external circuits. The contacts are either "closed" meaning the contacts are touching and electricity can flow between them, or "open", meaning the contacts are separated and the switch is non-conducting. The mechanism for actuating the transition between these two states (open or closed) can be either a simple toggle switch, illustrated for simplicity as 11 in FIG. 2.

The lamp base 10 further comprises a spinning component assembly 30. The spinning component assembly 30 has an output shaft (332 in FIGS. 3 and 4) which is connected to primary rotating gear 335 and to the inner cover 40. As will be more fully described, amounting base 330 has a central opening (333 in FIG. 2) which is closely received and frictionally engaged by the output shaft 332. Thus, when the output shaft is turned by the motor 310 through the rotating gear system illustrated, the mounting base is also turned. The inner cover 40 is mounted to the mounting base 330 so that it turns with the mounting base. The inner cover 40 covers the LED bulb 20. The inner cover 40 has an exterior surface which is provided with cutout pattern holes (410 in FIG. 2). The lamp base 10 is also fitted with a transparent lamp shade 50, said transparent lamp shade 50 being superimposed above and surrounding the inner cover 40.

As has been described, in use, the festive atmosphere decorative lighting device of the invention is actuated by a switch assembly, in this case by the toggle switch 11. Since the inner cover 40 is located between the LED bulb 20 and the transparent lamp shade 50, turning the power switch on causes the LED bulb 20 to emit light after being energized. The power switch also turns on the spinning component assembly 30 which drives the inner cover 40 and causes it to spin. Movement of the cutout pattern holes on the inner cover 40 over the LED bulb 20 enables the emission of light with the emitted light passing through the cutout pattern holes 410 to present the previously described flowing vivid silhouette. This makes for a very pleasing visual expression as a decorative lighting fixture.

Figure 3:
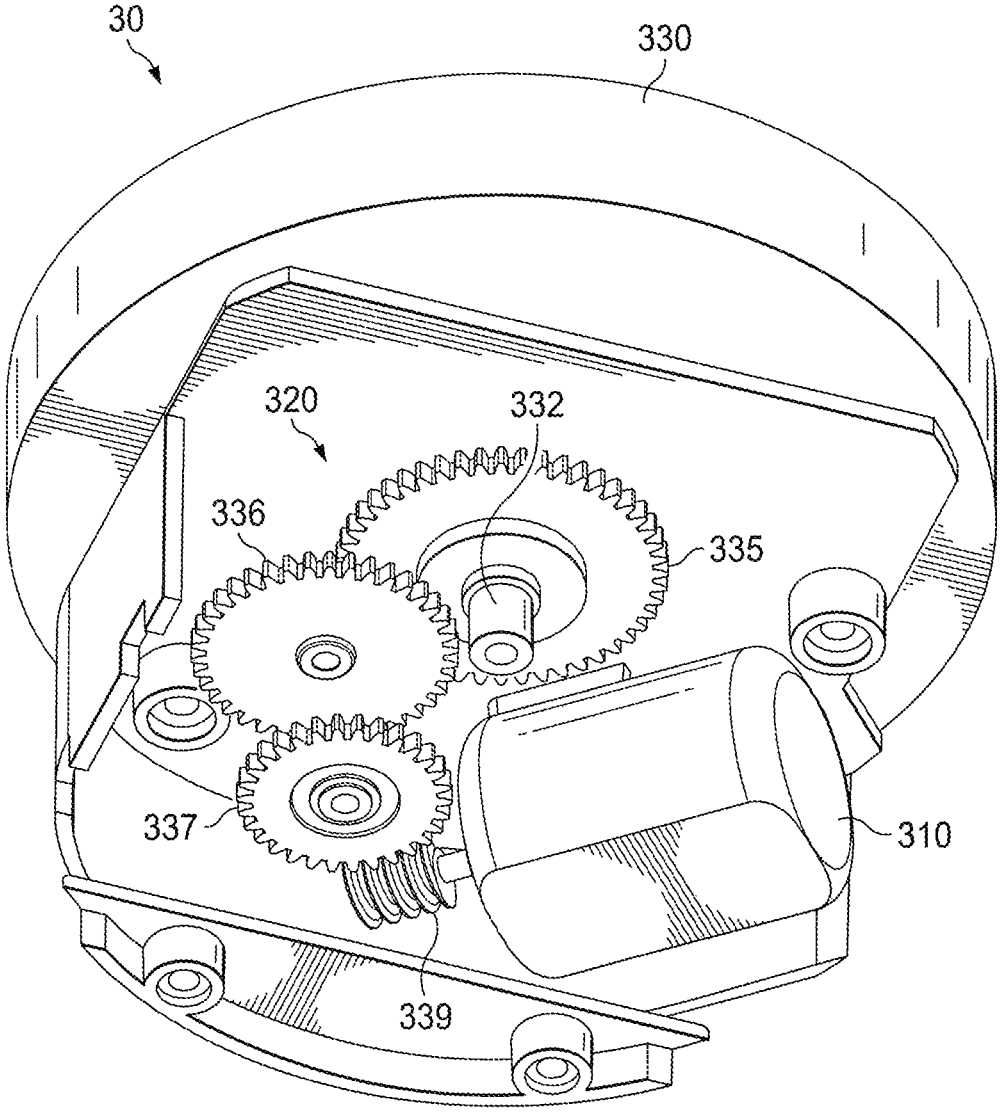
FIG. 3 is an isolated view of the spinning configuration structure of the device of FIG. 2.

As depicted in FIG. 3, in one embodiment, the spinning component assembly 30 includes a drive motor 310 and a gear reduction configuration (generally at 320 in FIG. 3) housed below a bottom surface of the mounting base 330 in the lamp base 10. In the embodiment shown, the gear reduction configuration 320 includes a primary, secondary and tertiary rotating gears (335, 336 and 337, respectively in FIG. 3) of successively smaller outer diameter. The tertiary gear 337 is driven by a worm gear 339 which is carried on the output shaft of the motor 310. Movement of the worm gear 339 turns the tertiary gear, which in turn causes the rotation of the secondary gear 336 and the primary gear 335. The primary gear 335 is carried on a lower extent of the output shaft 332 which, as has been explained, is connected to the mounting base so that rotation of the output shaft 332 causes rotation of the mounting base 330. The inner cover 40 is fixed with the mounting base 330.

The purpose of the gear reduction configuration 320 is to slow down the rotation speed of the mounting base, through the reducing gears 335, 336 and 337. The reduction gear configuration 320 with its simple gear transmission is reliable, and the entire structure is simple, resulting in a lower production cost. The drive motor 310 can be any convenient commercially available design and can be powered by either external power supply or the batteries inside of the built in battery compartment of the lamp base 10 (illustrated generally at 340 in FIG. 2). The drive motor 310 and the LED bulb 20 can conveniently be connected to the same power supply.

As depicted in FIG. 2, in one embodiment, the LED bulb 20 has a mounting axis 312 which is vertical to the horizontal plane of the lamp base 10. The inner cover 40 has a spinning axis which is coaxial with the LED bulb's mounting axis. For example, if the mounting base 10 is set horizontally, then the bulb 20 is assembled vertically in the mounting base 10. In other words, the mounting axis of the bulb 20 is vertically set, and the spinning axis of the inner cover 40 is vertically coaxial with the bulb 20 mounting axis. Thus, the inner cover 40 spins horizontally, with the result being that the light spot projected on the lamp shade 50 also flows horizontally, thus, the pattern flows regularly, with the result being a better view.

In one embodiment, the lamp shade 50 and the inner cover 40 are spherical bodies with bottom openings which are coaxially set with the center point of the LED bulb 20. By doing so, the light passing through the cutout holes 410 of the inner cover 40 is projected on the outside transparent lamp shade 50 symmetrically, so that the so formed light spot image is not deformed, and also is not deformed during the spinning, thus further improving the regularity of the pattern.

Figure 4:
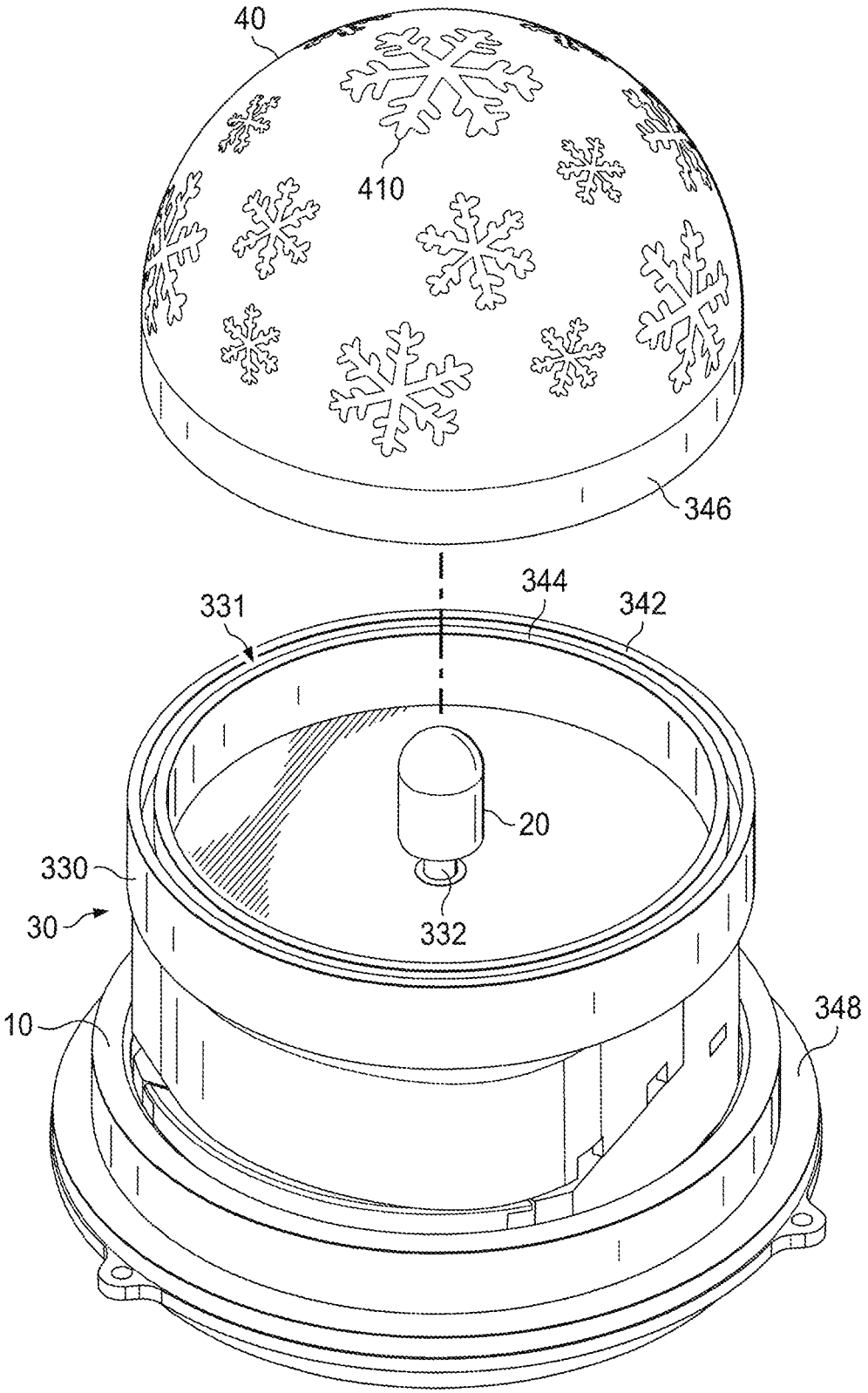
FIG. 4 is an isolated view of the assembled lamp base, spinning configuration and LED bulb with the inner cover being shown in exploded fashion.

As depicted in FIG. 4, in one embodiment, the mounting base 330 has a pair of concentric upstanding sidewalls 342, 344, which together define an exposed circular groove 331 about the periphery thereof. The inner cover 40 has a lower circumferential edge region (346 in FIG. 4) which is detachably engaged in the circular groove 331 by pushing the same downwardly in the groove. By using a simple frictional engagement, it is possible to change out the inner cover 40, i.e., to take out the inner cover 40 from the circular groove 331, and replace it with a different patterned inner cover 40. In this way, one light can show different decorative patterns, so that it increases the scope of the application of the atmospheric lighting device.

In one embodiment, said lamp shade 50 is made of glass and can be detachably engaged so that it rests on an outer rim region (348 in FIG. 4) of the lamp base 10. Glass is a good choice for the material for making the lamp shade 50, since glass performs well in terms of light perspective and transmission, and the glass molecular alignment is regular, and the molecules in space have statistically uniformity. As a result, the physical properties of the glass material, such as the refractive index, hardness, elastic modulus, thermal expansion coefficient, and thermal conductivity are substantially the same in all aspects. When light is emitted from the inner cover 40 and projects on the inner surface of the glass-made lamp shade 50, the patterns or flowing patterns the viewer sees do not tend to be deformed, thereby producing a crystal clear display with good pattern regularity and visual effect.

In one embodiment, said lamp shade 50 internal surface or external surface is colored with a coloring layer. This could be accomplished by spray painting with a suitable pigment. By using a coloring layer, the formed patterns produced by the light spots passed through the pattern holes 410 are more obvious relative to the shadow formed by the covered area of the inner cover 40, which improves patterns' clarity and further improves the viewing effect.

In one embodiment, said lamp shade 50 internal surface is formed with a frosted diffuse layer. As will be familiar to those skilled in the relevant arts, frosted glass can be produced by sandblasting or acid etching a clear body of glass. By using such a frosted diffuse layer, the light is more uniform after transmission through the lamp shade 50, so the patterns' regularity is further improved.

As depicted in FIG. 1, in one embodiment, the lamp base 10, and thus the lamp shade 50, is suspended in the air with a suitable suspension device (designated generally as 60 in FIG. 1). The suspension device can include a suspension hook 610 extending upwardly above the lamp shade top in use. The hook has a downwardly extending shaft 612 which has multiple fixed strips (such as strips 614, 616, 618) depending therefrom. The strips can be formed of any convenient flexible material, such as cloth or plastic. Each of the fixed strips has a lower end which is connected to the lamp base by a spring clip, such as clip 620. Preferably, the fixed strips are symmetrically distributed along the lamp shade lower periphery with the spring clips being received in mounting holes on the lower periphery. In the example shown, there are three strips each distributed 120° apart about the periphery of the lamp base 10.

By using the suspension device 60, the festive atmosphere decorative light can be suspended in space, while at the same time, the suspension device 60 can constrain the lamp shade 50 in the lamp base 10, so that it improves the assembly's firmness and the operational reliability.

The described basic embodiment of the invention can be modified in various ways to further enhance the festive effect. In one embodiment, the switch configuration of the lamp can be provided as a sound/light sensor control switch. By doing so, the switch can be controlled by light or sound to control the spinning configuration 30 and to turn the LED bulb 20 on or off, thus offering more convenient operation for the user in some circumstances. Any of a number of sound/light sensors controls switches are available commercially in the marketplace.

The above described embodiment of the invention is a preferred embodiment only. It will be understood by those skilled in the relevant arts that various changes and modifications can be made which do not deviate from the premise of the present invention. A number of improvements and transformations can be made, and these improvements and transformation should not be considered as being outside the scope of protection of the present invention.

What is claimed is:

1. A festive atmosphere decorative lighting device designed to provide festive decorative effects including rich forms of expression, the device comprising:

a lamp base;

an LED bulb set inside the lamp base;

a switch assembly contained within the base in electrical communication with the LED bulb for switching the LED bulb on and off;

a spinning component assembly, the spinning component assembly including an output shaft which is operably associated with an inner cover for causing the inner cover to spin, the inner cover being arranged on the lamp base to cover the LED bulb;

wherein the inner cover is provided with a cutout pattern of holes; and wherein the lamp base also carries a transparent lamp shade, the transparent lamp shade being superimposed over the inner cover and surrounding the inner cover.

2. The device of claim 1, wherein the spinning component assembly includes a drive motor and a gear reduction configuration, and a mounting base, and wherein the gear reduction configuration has a plurality of driven gears which are connected to an output shaft of the drive motor by a worm gear.

3. The device of claim 2, wherein the mounting base is located above the gear reduction configuration and below the inner cover when assembled, and wherein the inner cover is attached to the mounting base.

4. The device of claim 3, wherein the LED bulb sits inside the lamp base above the mounting base when the lighting device is assembled, the LED bulb being mounted on an outer extent of an output shaft of the gear reduction configuration.

5. The device of claim 4, wherein rotation of the output shaft of the gear reduction configuration causes rotation of the mounting base and, in turn, rotation of the inner cover.

6. The device of claim 5, wherein the LED bulb has a mounting axis passing vertically through a center point of the Led bulb, and wherein the LED bulb's mounting axis is perpendicular to a horizontal planar surface of the lighting base, and wherein the inner cover has a spinning axis defined along a vertical axis thereof, the inner cover's spinning axis being coaxial with the LED bulb's mounting axis.

7. The device of claim 3, wherein the lamp shade and the inner cover are both spherically shaped bodies and are coaxially arranged with the LED bulb mounting axis.

8. The device of claim 4, wherein the mounting base has a top surface with a pair of concentric upstanding sidewalls which together define an exposed circular groove about the periphery thereof, and wherein the inner cover has a lower circumferential edge region which is detachably engaged in the circular groove by pushing the same downwardly in the groove.

9. The device of claim 8, wherein the lamp shade is detachably engaged on the lamp base.

10. The device of claim 9, wherein the lamp shade has an internal surface and an external surface, a selected one of which is colored with a coloring layer.

11. The device of claim 9, wherein, said lamp shade internal surface has a frosting applied thereto to form a frosted diffuse layer.

12. The device of claim 3, wherein the switch configuration further comprising a sound/light sensor control switch.

13. The device of claim 3, wherein the lamp base is suspended with a suspension device, the suspension device including a suspension hook extending upwardly above a top region of the lamp shade in use, the hook having downwardly extending shaft which has multiple fixed strips depending therefrom, each of the fixed strips having a lower end which is connected to the lamp base.

14. The device of claim 13, wherein the fixed strips each has a lower connecting end which is connected to the base at a connecting point, the connecting points of the fixed strips being symmetrically distributed about the lamp base.

* * * * *